US010635022B2

(12) United States Patent
Ishii

(10) Patent No.: US 10,635,022 B2
(45) Date of Patent: Apr. 28, 2020

(54) TONER CONTAINER

(71) Applicant: KYOCERA Document Solutions Inc., Osaka-shi, Osaka (JP)

(72) Inventor: Akira Ishii, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/368,617

(22) Filed: Mar. 28, 2019

(65) Prior Publication Data

US 2019/0302653 A1 Oct. 3, 2019

(30) Foreign Application Priority Data

Mar. 29, 2018 (JP) ..... 2018-064918

(51) Int. Cl.
*G03G 15/08* (2006.01)

(52) U.S. Cl.
CPC ..... *G03G 15/0889* (2013.01); *G03G 15/0865* (2013.01); *G03G 15/0822* (2013.01); *G03G 15/0872* (2013.01)

(58) Field of Classification Search
CPC ..... G03G 15/0822; G03G 15/0865; G03G 15/0872; G03G 15/0875; G03G 15/0877; G03G 15/087; G03G 15/0889
See application file for complete search history.

(56) References Cited

U.S. PATENT DOCUMENTS 7,720,418 B2 * 5/2010 Tanaka ..... G03G 15/0875 399/260
2014/0037342 A1 2/2014 Yamanaka

FOREIGN PATENT DOCUMENTS

JP 201429412 A 2/2014

* cited by examiner

*Primary Examiner* — Hoang X Ngo
(74) *Attorney, Agent, or Firm* — Alleman Hall Creasman & Tuttle LLP

(57) ABSTRACT

A toner container includes a container body, a first projecting member, a second projecting member, and a plurality of rotational members. The first projecting member and the second projecting member are provided on a bottom surface of the container body, configured to divide an inner space of the container body into a plurality of storage chambers that are juxtaposed in a width direction of the container body, and formed parallel to one another. The plurality of rotational members are rotatably provided, respectively, in the plurality of storage chambers, and juxtaposed in the width direction. Each rotational member includes a rotational shaft body, and a film-like stirring member that is attached to the rotational shaft body and extends in a direction perpendicular to that of the rotational shaft body. A height of the first projecting member from the bottom surface is different from that of the second projecting member.

3 Claims, 12 Drawing Sheets

TONER CONTAINER

INCORPORATION BY REFERENCE

This application is based upon and claims the benefit of priority from the corresponding Japanese Patent Application No. 2018-064918 filed on Mar. 29, 2018, the entire contents of which are incorporated herein by reference.

BACKGROUND

The present disclosure relates to a toner container in which a rotational member is provided.

An image forming apparatus such as a multifunction peripheral or a printer for electrophotographically forming an image on a print sheet is installed with a developing device. Developer including toner is stored inside the developing device. The developing device, by using toner in the developer, develops an electrostatic latent image that is formed on an image-carrying member such as a photoconductor drum. The amount of toner inside of the developing device decreases when the developing is performed. Accordingly, the image forming apparatus includes a toner container in which toner is stored, and the toner container is configured to replenish toner to the developing device. In addition, the toner container is removably attached to the image forming apparatus. When all of the toner inside the toner container is depleted, the toner container is replaced with a new toner container that is full of toner.

The toner container includes, on its inside, a rotational member for stirring toner. The rotational member includes a rotational shaft body, and a stirring member attached to the rotational shaft body. The rotational shaft body is rotatably supported inside the toner container. The stirring member is a film member formed by a resin film or the like, and extends in a direction perpendicular to that of the rotational shaft body. When the rotational shaft body is rotated, the stirring member rotates in the same direction as the rotational shaft body. With this configuration, toner inside the toner container is stirred by the stirring member.

SUMMARY

A toner container according to an aspect of the present disclosure includes a container body, a first projecting member, a second projecting member, and a plurality of rotational members. Toner is stored inside the container body. The first projecting member and the second projecting member are provided on a bottom surface of the container body, divide an inner space of the container body into a plurality of storage chambers that are juxtaposed in a width direction of the container body, and are formed parallel to one another. The plurality of rotational members are rotatably provided, respectively, in the plurality of storage chambers, and juxtaposed in the width direction. Each rotational member includes a rotational shaft body, and a film-like stirring member that is attached to the rotational shaft body and extends in a direction perpendicular to that of the rotational shaft body, and a height of the first projecting member from the bottom surface is different from that of the second projecting member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
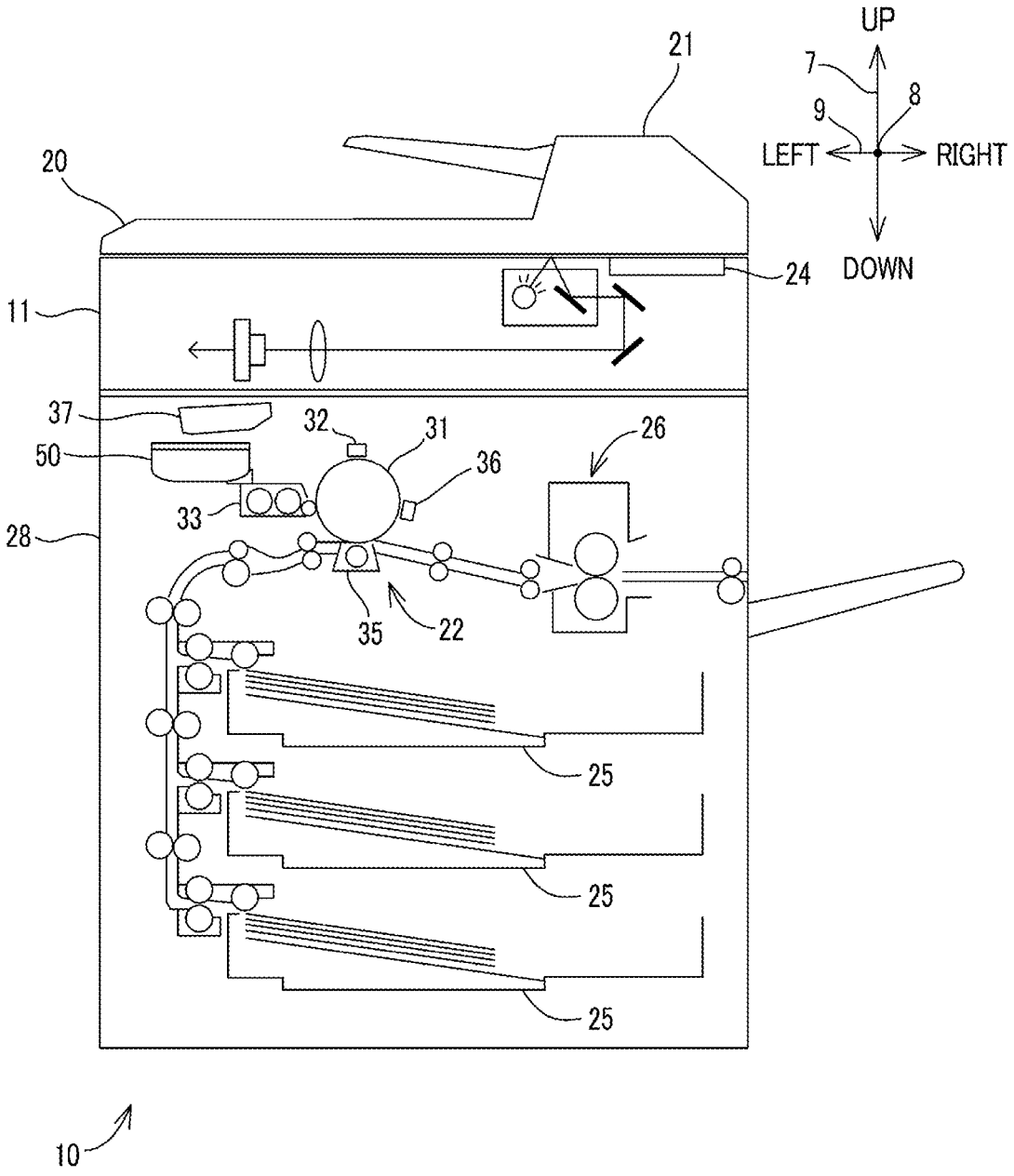
FIG. 1 is a diagram showing a configuration of an image forming apparatus according to an embodiment of the present disclosure.

The following describes an image forming apparatus 10, in which a toner container 50 is used, according to an embodiment of the present disclosure with reference to the accompanying drawings. In the following description, a vertical direction in a state (shown in FIG. 1) where the image forming apparatus 10 is installed on a flat surface is defined as an up-down direction 7. In addition, a front-rear direction 8 is defined on a basis that a side of the image forming apparatus 10 shown in FIG. 1 from which the toner container 50 is inserted is a near side (front face side). In addition, a left-right direction 9 is defined with reference to the near side (front face side) of the image forming apparatus 10 shown in FIG. 1.

[Configuration of Image Forming Apparatus 10]

The image forming apparatus 10 includes at least a print function, and is, for example, a multifunction peripheral. The image forming apparatus 10 uses developer including toner to print an image on a print document sheet. It is noted that the image forming apparatus 10 is not limited to a multifunction peripheral, and may be a peripheral device having a single function, such as a printer, a facsimile, or a copier.

As shown in FIG. 1, the image forming apparatus 10 mainly includes an image reading portion 11, a document sheet cover 20, an ADF (Auto Document Feeder) 21, an image forming portion 22, an operation/display portion 24, a plurality of sheet supplying portions 25, a fixing device 26, a toner container 50, and a control portion (not shown) that comprehensively controls the image forming apparatus 10. These components are attached to a housing 28 that forms an outer frame (not shown), an inner frame (not shown), and the like of the image forming apparatus 10.

The image forming portion 22 executes an image forming process for forming an image on a print sheet based on a so-called electrophotographic method. The image forming portion 22 prints the image on the print sheet, based on image data that is read by the image reading portion 11, or image data that is input from an external portion via a network communication portion (not shown). For example, when a print job is transmitted from a personal computer, the image forming portion 22 prints the image on the print sheet based on image data and print conditions included in the print job. As shown in FIG. 1, the image forming portion 22 includes a photoconductor drum 31, a charging device 32, a developing device 33, a transfer device 35, a neutralizing device 36, and an LSU (Laser Scanner Unit) 37.

When the image forming process executed by the image forming portion 22 is started, a surface of the photoconductor drum 31 is charged to a uniform potential by the charging device 32. Then, the LSU 37 scans, on the photoconductor drum 31, a laser beam corresponding to image data. This allows for an electrostatic latent image to be formed on the photoconductor drum 31. Toner is made to adhere to the electrostatic latent image by a developing process performed by the developing device 33, and a toner image is formed on the photoconductor drum 31. The toner image is transferred, by the transfer device 35, to a print sheet that is being conveyed along a conveyance path. The print sheet on which the toner image has been transferred is conveyed to the fixing device 26 that is disposed on a downstream side (righthand side in FIG. 1) of the image forming portion 22 in a conveyance direction of the print sheet. The toner is fixed to the print sheet by the fixing device 26, and an image is formed on the print sheet.

[Configuration of Toner Container 50]

In the following, a configuration of the toner container 50 will be described with reference to FIG. 2 to FIG. 10B. It is noted that in the drawings, with reference to an attitude (attached attitude) of the toner container 50 when it is attached to the housing 28, a vertical direction is defined as the up-down direction 7, an insertion-removal direction of the toner container 50 to and from the housing 28 is defined as the front-rear direction 8, and a horizontal direction when the housing 28 is viewed from its front surface is defined as the left-right direction 9.

The toner container 50 supplies toner to the developing device 33. The toner container 50 is removably attached to a container attachment portion (not shown) that is provided in the housing 28. The toner container 50 is slidably supported in the front-rear direction 8, such that it can be inserted and removed to and from the container attachment portion in the front-rear direction 8. As a slide supporting mechanism, a rail supporting mechanism configured by rail grooves and rail guides that are guides by the rail grooves may be used. The slide supporting mechanism is not limited to the rail supporting mechanism, and may be any mechanism as long as it slidably supports the toner container 50 in the front-rear direction 8.

Figure 2:
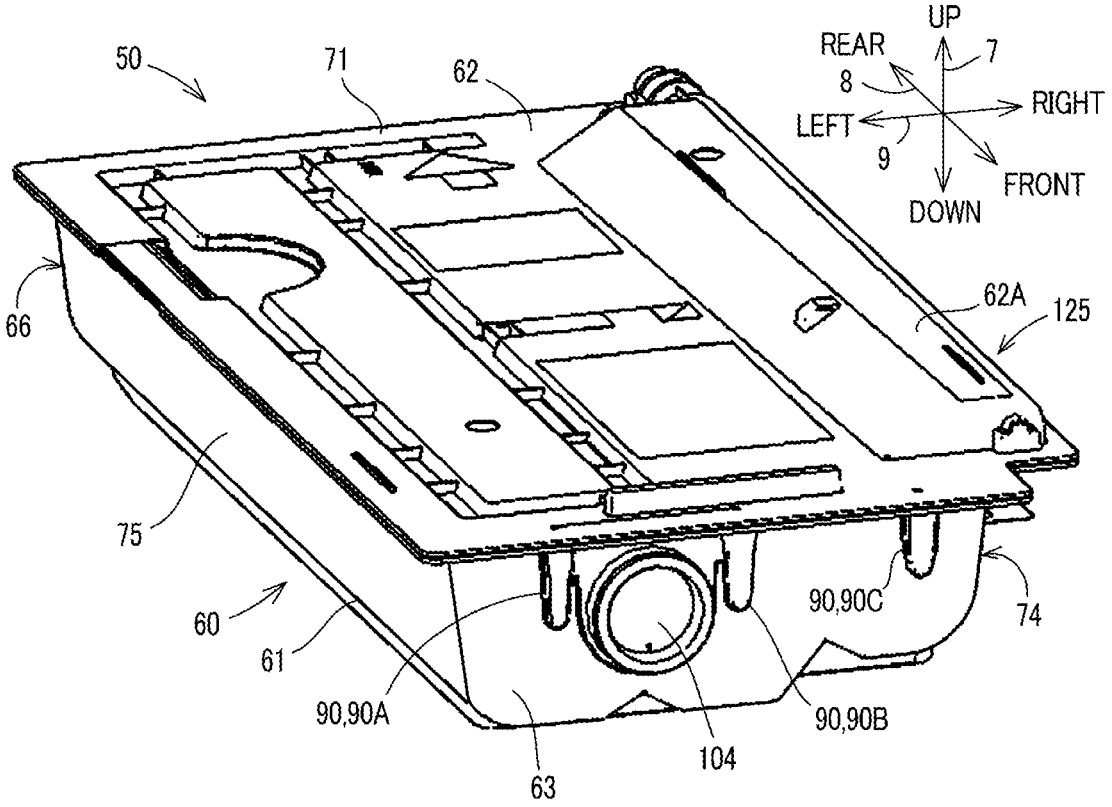
FIG. 2 is a perspective diagram showing a toner container viewed from its frontward and obliquely upward side.

As shown in FIG. 2, the toner container 50 is formed elongated in the front-rear direction 8. The toner container 50 includes a container body 60 that forms a housing of the toner container 50. The container body 60 is a synthetic resin product made by injection molding, using a thermoplastic synthetic resin such as ABS resin, PET (polyethylene terephthalate) resin, or a kind of synthetic resin that is made mainly of the two.

The container body 60 is formed by a lower housing 61 and a lid body 62. The lower housing 61 is for storing toner, and has a box-like shape that is elongated in the front-rear direction 8. Specifically, the lower housing 61 is partitioned off in the front-rear direction 8 by a front wall 63 on its front side and a rear wall 66 on its rear side. The front wall 63 and the rear wall 66 are plate-like members elongated in the vertical direction, and are provided facing one another and separated from one another in the front-rear direction 8 by a specific distance. It is noted that the front wall 63 and the rear wall 66 are an example of a pair of side walls In addition, the lower housing 61 is partitioned off in the left-right direction 9 by a left wall 75 on its left side and a right wall 74 on its right side. In addition, the lower housing 61 includes a bottom plate 64 that partitions off a bottom side of the lower housing 61.

The lower housing 61 includes a rectangular opening portion 65 (see FIG. 3) that is a wide opening on an upper surface of the lower housing 61. That is, the upper surface of the lower housing 61 is open. A lid body 62 is attached to the upper surface of the lower housing 61 such that it covers the opening portion 65. In this way, the container body 60 is partitioned off by the front wall 63, the rear wall 66, the left wall 75, the right wall 74, the bottom plate 64, and the lid body 62. Toner to be used in the developing process by the developing device 33 is stored inside the container body 60 that is configured as described above. It is noted that the container body 60 is not limited to the configuration with the lid body 62 provided on its upper surface, and may have any configuration as long as it is formed in a shape in which toner can be stored.

The lid body 62 is formed, in correspondence to a shape of the upper surface of the lower housing 61, in a rectangular shape elongated in the front-rear direction 8. The lid body 62 covers and closes off the opening portion 65 (see FIG. 3) of the lower housing 61, and includes a peripheral portion 71 that comes in contact with a rim of the opening portion 65. In the container body 60, the rim of the opening portion 65 of the lower housing 61 and the peripheral portion 71 of the lid body 62 are welded together.

Three protruding members 77 (77A, 77B, 77C) that protrude downward from a back surface 76 of the lid body 62 are provided on an edge portion of a front side of the lid body 62. The protruding members 77 are provided at positions corresponding to those of three bearing portions 90 (90A, 90B, 90C) described below. Specifically, each protruding member 77 is provided at a position where, when the lid body 62 closes off the opening portion 65, the protruding member 77 is inserted in a long groove 91 of the corresponding bearing portion 90. The protruding members 77 have cross-shaped cross-sections, are formed in the same shape and size, and have the same protrusion length. It is noted that, among the three protruding members 77, the protruding members 77A and 77B corresponding to the bearing portions 90A and 90B are examples of a first protruding member, and the protruding member 77C corresponding to the bearing portion 90C is an example of a second protruding member.

A filling port 104 for filling an inner portion of the lower housing 61 with toner, is provided on the front wall 63 of the lower housing 61. The filling port 104 is provided on the left wall 75 side of the front wall 63. Specifically, the filling port 104 is disposed at a position that is on a left side of a center of the front wall 63 in the left-right direction 9.

In addition, as shown in FIG. 2, the three bearing portions 90 juxtaposed in the left-right direction 9 are provided in the front wall 63. Each bearing portion 90 rotatably supports a rotation shaft 551 (see FIG. 7) provided on a front side of each of three rotational members 54 (54A, 54B, 54C) that are provided inside the container body 60.

Figure 5:
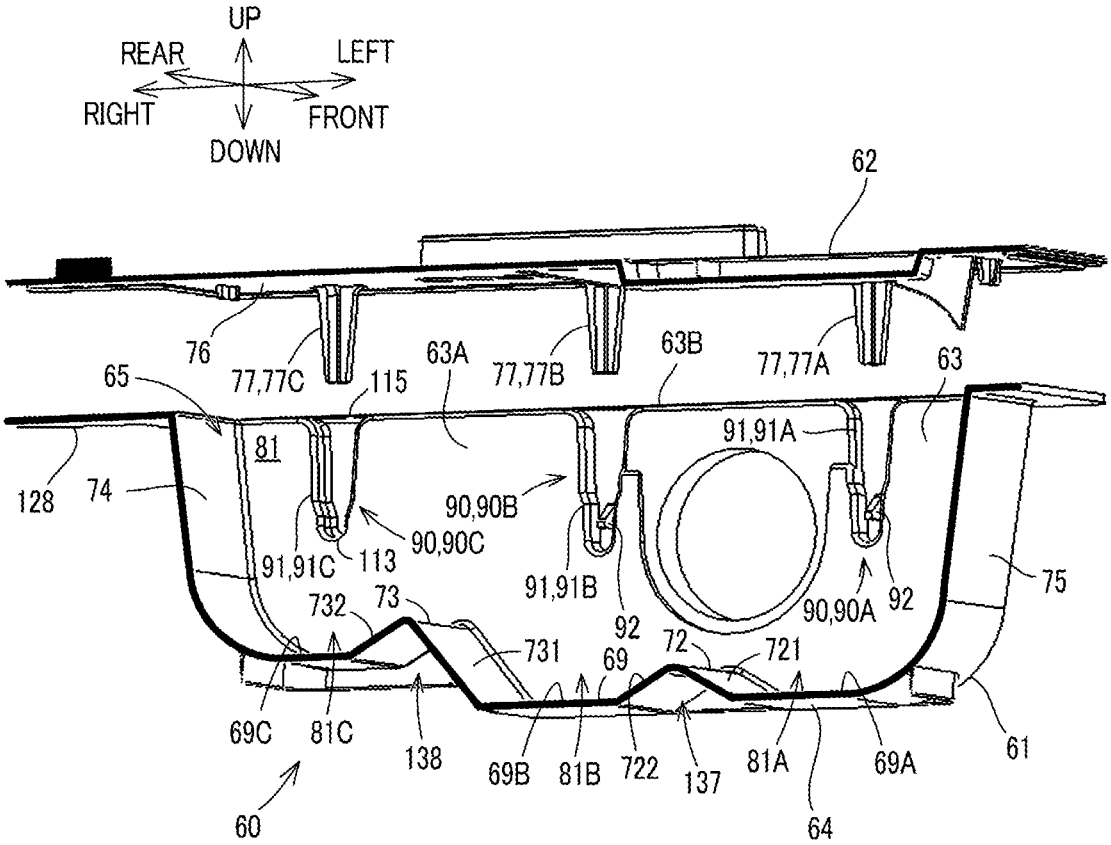
FIG. 5 is a diagram showing a cross-section of a frontward part of the toner container viewed from its inside.

As shown in FIG. 5, the bearing portions 90 respectively include the long grooves 91 (91A, 91B, 91C) that are formed elongated in the up-down direction 7 in an inner surface 63A of the front wall 63. Each long groove 91 is formed by pushing out the front wall 63 frontward from the inner surface 63A, when forming the container body 60 by injection molding with a metal mold. Accordingly, each bearing portion 90 is formed in a shape that protrudes outward (frontward) from the front wall 63. A lower end portion of the long groove 91 supports the rotation shaft 551 when the rotation shaft 551 is inserted in the long groove 91.

In the present embodiment, among the three bearing portions 90, the two bearing portions 90A and 90B positioned near the filling port 104 are shaped differently from the bearing portion 90C that is positioned at a rightmost position. Configurations of the bearing portions 90 (90A, 90B, 90C) are described below. It is noted that the bearing portions 90A and 90B are examples of a first bearing portion, and the bearing portion 90C is an example of a second bearing portion.

Figure 6:
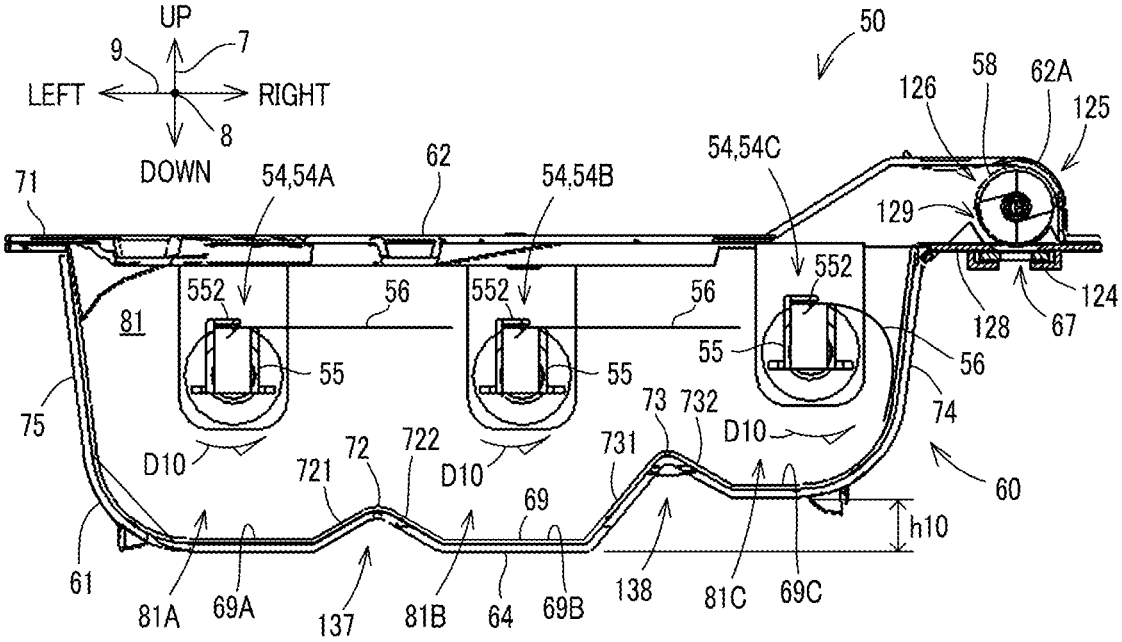
FIG. 6 is a cross-sectional diagram showing an attached state of the rotational members.

As shown in FIG. 6, the three rotational members 54 (54A, 54B, 54C) are provided inside the container body 60. Each rotational member 54 stirs the toner that is stored inside the container body 60. The rotational member 54 is formed elongated in the front-rear direction 8, and is disposed extending along the front-rear direction 8 inside the container body 60. The three rotational members 54 are disposed separate from one another by a specific distance inside the container body 60.

In the present embodiment, an inner space 81 of the container body 60 is divided into three toner storing chambers 81A, 81B, and 81C (an example of a plurality of storage chambers). The rotational member 54 is rotatably provided at each center of the three toner storage chambers 81A, 81B, and 81C. The three toner storage chambers 81A, 81B, and 81C are divided in the left-right direction 9 (a width direction of the container body 60) that is perpendicular to a shaft direction of the rotational members 54, and divide the inner space 81 into substantially equal sections in the left-right direction 9.

The toner storage chambers 81A, 81B, and 81C are not divided by shielding plates or the like, but by two ribs 72 and 73 that are formed parallel to one another on a bottom surface 69 (an inner surface of the bottom plate 64) inside the container body 60, such that toner can be moved between the toner storage chambers 81A, 81B, and 81C. In the present embodiment, the rib 72 (an example of a first projecting member) divides the toner storage chamber 81A that is on a left side from the toner storage chamber 81B that is in center. In addition, the rib 73 (an example of a second projecting member) divides the toner storage chamber 81B that is in the center from the toner storage chamber 81C that is on a right side.

The ribs 72 and 73 project upward from the bottom surface 69, and extend in the front-rear direction 8. The ribs 72 and 73, for example, are formed along the front-rear direction 8 and each have a chevron-shaped cross-section. It is noted that the ribs 72 and 73 are not limited to having the chevron-shape cross-section, and may be plate-like members that are perpendicular to the bottom surface 69 and extend in the front-rear direction 8. The ribs 72 and 73 are formed by two groove portions 137 and 138 that are formed in the bottom plate 64 and extend in the front-rear direction 8. That is, by forming the groove portions 137 and 138 in the bottom plate 64, the chevron-shaped ribs 72 and 73 that extend in the front-rear direction 8 appear on the bottom surface 69 of the container body 60, and the ribs 72 and 73 divide the inner space 81 of the container body 60 into the toner storage chambers 81A, 81B, and 81C. The three toner storage chambers 81A, 81B, and 81C are divided such that the toner storage chamber 81C is formed on a supply port 67 side, and the toner storage chambers 81A and 81B are formed on an opposite side (left side) of the supply port 67. It is noted that the toner storage chambers 81A and 81B are examples of a first storage chamber, and the toner storage chamber 81C is an example of a second storage chamber.

As described above, the rotational members 54 are respectively provided in the three toner storage chambers 81A, 81B, and 81C. Specifically, the rotational member 54A is provided in the toner storage chamber 81A, the rotational member 54B is provided in the toner storage chamber 81B, and the rotational member 54C is provided in the toner storage chamber 81C. It is noted that the rotational members 54A and 54B are examples of a first rotational member, and the rotational member 54C is an example of a second rotational member.

In the present embodiment, a depth of the toner storage chambers 81A and 81B from the opening portion 65 is formed deeper than that of the toner storage chamber 81C. Accordingly, in comparison to a conventional container body that is formed with a flat bottom surface, the container body 60 has a larger storage volume. As described below, it is necessary to lift up, to a toner conveyance path 126, toner inside the toner storage chamber 81C by using the rotational member 54C. For this reason, the toner storage chamber 81C is formed shallower than the toner storage chambers 81A and 81B so that the toner can be moved more efficiently to the toner conveyance path 126 by the rotational member 54C. In other words, a bottom surface 69C of the toner storage chamber 81C is positioned higher than bottom surfaces 69A and 69B of the respective toner storage chambers 81A and 81B, and the bottom surface 69 includes a height difference h10 (see FIG. 6) between the bottom surface 69C and the bottom surfaces 69A and 69B.

As shown in FIG. 5 and FIG. 6, the rib 73 on the supply port 67 side (right side) is formed at a higher position than the rib 72 that is on the opposite side (left side) of the supply port 67. Specifically, the rib 73 is formed at a position that is higher than that of the rib 72 by the height difference h10. Heights of the ribs 72 and 73 are specified as follows. The height of the rib 72 is specified so that, when the rotational member 54A rotates, a stirring member 56 of the rotational member 54A slides against an inclined surface 721 on a left side of the rib 72, and when the rotational member 54B rotates, the stirring member 56 of the rotational member 54B slides against an inclined surface 722 on a right side of the rib 72. A height of the rib 73 is specified so that, when the rotational member 54B rotates, the stirring member 56 of the rotation member 54B slides against an inclined surface 731 on a left side of the rib 73, and when the rotational member 54C rotates, the stirring member 56 of the rotational member 54C slides against an inclined surface 732 on a right side of the rib 73.

The inclined surfaces 721, 722, and 732 are all inclined substantially at the same angle. On the other hand, an incline angle of the inclined surface 731 is wider than those of the inclined surfaces 721, 722, and 732. Accordingly, the bottom surface 69A and 69B substantially have the same area, and the toner storage chamber 81A and 81B substantially have the same storage volume.

The rotational members 54 are formed in the same size and shape. That is, extending lengths of the stirring members 56 of the rotational members 54 are the same. As described above, since the toner storage chambers 81A and 81B are formed with depths deeper than that of the toner storage chamber 81C, the rotational members 54A and 54B that are respectively provided in the toner storage chambers 81A and 81B are positioned lower than the rotational member 54C, as shown in FIG. 6. This allows for the stirring members 56 to adequately slide against the bottom surfaces 69A and 69B of the respective toner storage chambers 81A and 81B.

Figure 7:
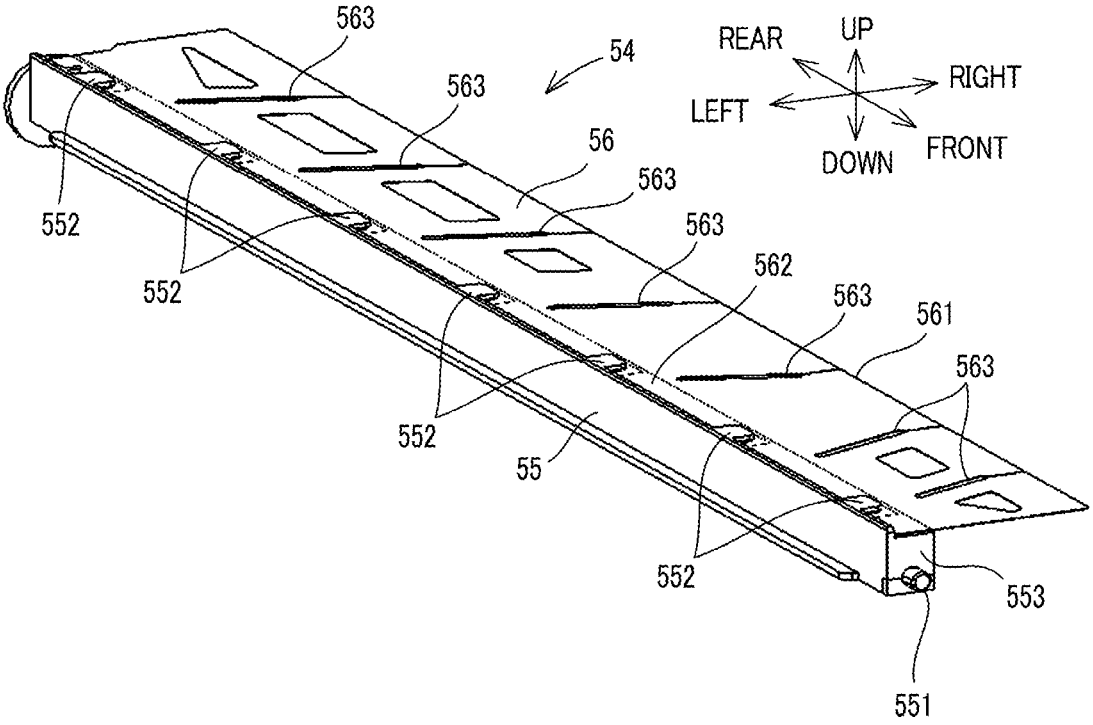
FIG. 7 is a perspective diagram showing a stirring member that is included in the toner container.

As shown in FIG. 7, each rotational member 54 includes a rotation shaft body 55 that is elongated in the front-rear direction 8, and the stirring member 56 that is attached to the rotation shaft body 55.

Each rotation shaft body 55 is provided inside the container body 60 such that it can rotate together with the stirring member 56. That is, the rotation shaft body 55 is rotatably supported inside the container body 60. The rotation shaft body 55 is a shaft member formed in a rectangular tube shape that is elongated in one direction, and is a synthetic resin product formed by injection molding. Accordingly, the rotation shaft body 55 can bend in a direction that is perpendicular to its shaft direction (longitudinal direction).

The rotation shaft body 55 is rotatably supported in the container body 60. In the present embodiment, both sides in the longitudinal direction of the rotation shaft body 55 are rotatably supported on the side walls of the container body 60. Specifically, the rotation shaft body 55 includes the rotation shaft 551 on one of its ends (front end) in the longitudinal direction. The rotation shaft 551 is rotatably supported by the bearing portion 90, described below, that is formed in the front wall 63 on one side in a longitudinal direction of the container body 60. It is noted that a shaft hole (not shown) is formed on the other end (rear end) of the rotation shaft body 55. A joint is inserted from an outer side into a through hole 661 (see FIG. 3) that is formed in the rear wall 66, and a shaft portion of the joint is inserted into the shaft hole. With this configuration, the other end of the rotation shaft body 55 is rotatably supported on the rear wall 66.

The rotation shaft 551 and the shaft hole are respectively provided on two side surfaces in the longitudinal direction of the rotation shaft body 55, each at a position that is shifted, toward one side (downward in FIG. 7) in a transverse direction of the rotation shaft body 55, from a center of the respective side surface. In addition, on a surface on an opposite side (upper side in FIG. 7) of the one side of the rotation shaft body 55, a plurality of support portions 552 are provided separated from one another in the longitudinal direction by a specific distance. The support portions 552 support an attachment portion 562 of the stirring member 56. By being supported by the support portions 552, the stirring member 56 is held in a state where it extends in a direction that is perpendicular to that of the rotation shaft body 55.

In the present embodiment, as shown in FIG. 6, the rotational members 54 are attached to the container body 60 such that the stirring members 56 extend in the same direction. This allows for the rotational members 54 to be attached easily, and prevents the stirring members 56 from overlapping with one another when they are rotated. For example, when the stirring members 56 of the juxtaposed rotational members 54 extend in different directions, it is necessary to correct, to a specific angle, attachment angles of the three rotational members 54 about their shafts, after the rotational members 54 have been attached. In addition, if the attachment angles of the rotational members 54 are not corrected to the specific angle, the stirring members 56 overlap with one another when they are rotated, and there is a risk of their stirring and transport abilities of toner becoming reduced. It is noted that FIG. 6 shows a state where all of the stirring members 56 of the rotational members 54 extend rightward.

Each stirring member 56 is made of an elastic material such as PET (polyethylene terephthalate) resin, and is formed in a thin film-like shape. The stirring member 56 is not limited to being made of PET resin, but may be made of a synthetic resin such as vinyl chloride and polycarbonate. The stirring member 56 is attached to the rotation shaft body 55. In the present embodiment, the stirring member 56 is attached along an entirety of the rotation shaft body 55 in the longitudinal direction, and formed elongated in the longitudinal direction of the rotation shaft body 55. The stirring member 56 includes a plurality of slits 563 that are formed from an end portion 561 toward the attachment portion 562. With this configuration, each portion (moveable piece) adjacent to the slits 563 can bend independently about the shaft of the rotation shaft body 55, and stirring efficiency is improved.

It is noted that as shown in FIG. 6 and FIG. 11, when the stirring member 56 is disposed inside the container body 60, the end portion 561 of the stirring member 56 comes in contact with an inner surface (the back surface 76 of the lid body 62 or an inner surface of the lower housing 61) of the container body 60, depending on a rotational attitude of the rotational member 54. This is due to the stirring member 56 being formed longer than a distance from the rotation shaft body 55 to the inner surface of the container body 60. Accordingly, when the rotational member 54 is attached inside the container body 60 and rotates, the end portion 561 of the stirring member 56 is bent by coming in contact with the bottom plate 64, the back surface 76 of the lid body 62, the right wall 74, and the left wall 75. The end portion 561 of the stirring member 56 is slid along, while in contact with, the inner surface of the container body 60.

As shown in FIG. 6, the lower housing 61 includes the supply port 67 for supplying, to the developing device 33, toner that is stored inside the container body 60. The supply port 67 is formed on a toner conveyance portion 125 described below that protrudes rightward from an upper edge of the right wall 74 of the container body 60. In addition, a shutter 124 for opening and closing the supply port 67 is provided on the lower housing 61. When the toner container 50 is attached to the housing 28 at an attachment position, the shutter 124 is slid and the supply port 67 is opened. In addition, when the toner container 50 is pulled out from the attachment position, the shutter 124 is slid in an opposite direction, and the supply port 67 is closed.

The toner conveyance path 126 for conveying toner to the supply port 67 is formed inside the container body 60. The toner conveyance path 126 extends in the front-rear direction 8 and is formed inside the toner conveyance portion 125 that is formed on a right edge portion of an upper portion of the container body 60.

Figure 3:
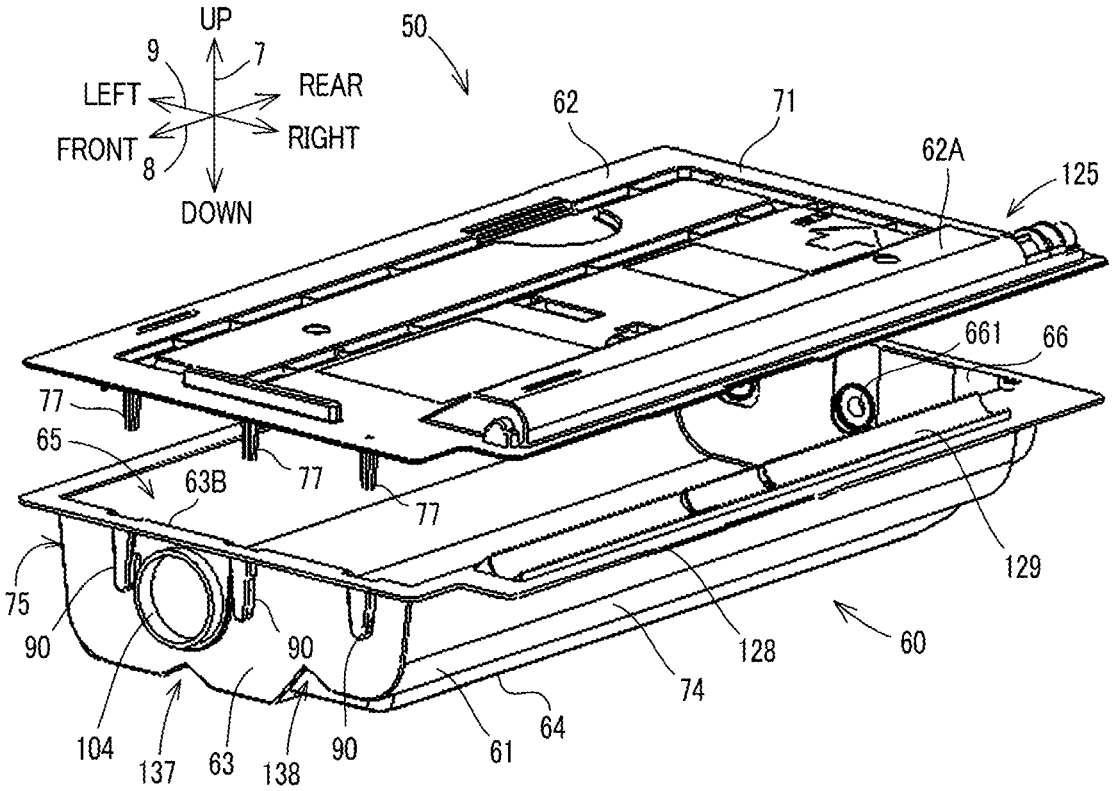
FIG. 3 is an exploded-view diagram showing the toner container.

As shown in FIG. 3, the lower housing 61 includes an extended portion 128 that horizontally extends rightward from the upper edge portion of the right wall 74. An arc-shaped curved wall 129 that curves downward is formed on an upper surface of the extended portion 128. In addition, on a right edge portion of the lid body 62, a bulge portion 62A is formed that bulges upward from the lid body 62 and away from the extended portion 128 and the curved wall 129, so that the toner conveyance path 126 can be formed between the extended portion 128 and the curved wall 129. The toner conveyance portion 125 is formed by the extended portion 128, the curved wall 129, and the bulge portion 62A, and the toner conveyance path 126 is formed inside the toner conveyance portion 125. That is, the toner conveyance path 126 is a space that is surrounded by the bulge portion 62A of the lid body 62 and the curved wall 129 of the extended portion 128.

The supply port 67 is provided in the toner conveyance path 126. That is, the toner conveyance path 126 includes the supply port 67. Specifically, the supply port 67 is formed on the curved wall 129 of the extended portion 128 that forms a bottom surface of the toner conveyance portion 125.

In addition to the three rotational members 54 (54A, 54B, 54C), a conveyance member 58 for conveying toner inside the toner conveyance path 126 to the supply port 67 is provided inside the container body 60.

Figure 4:
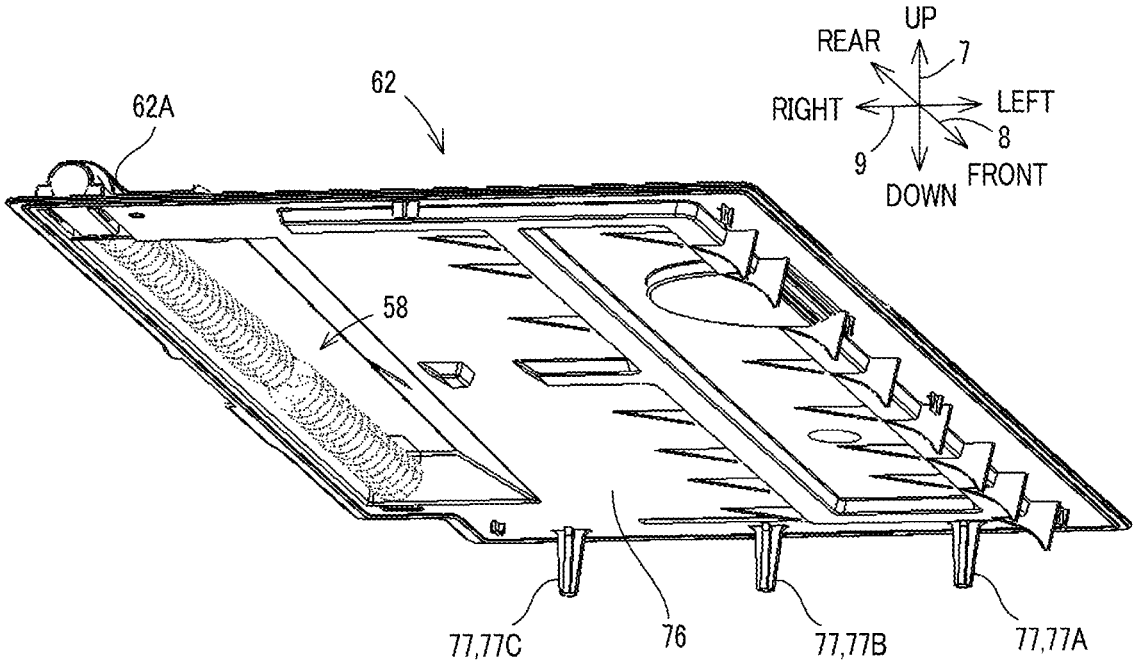
FIG. 4 is a perspective diagram showing a lid body of the toner container.

The conveyance member 58 is rotatably provided in the toner conveyance path 126. Specifically, as shown in FIG. 4, the conveyance member 58 is rotatably supported by two side walls on both ends in the front-rear direction 8 of the bulge portion 62A of the lid body 62. The conveyance member 58, for example, is a screw shaft formed by a spiral wing on a shaft member. When the conveyance member 58 is rotated, toner inside the toner conveyance path 126 is conveyed to the supply port 67 by the conveyance member 58. The conveyance member 58 may have any configuration as long as it can convey the toner inside the toner conveyance path 126 to the supply port 67.

[Configuration of Bearing Portion 90C]

The bearing portion 90C supports the rotation shaft 551 of the rotational member 54C (see FIG. 7), and as shown in FIG. 5, is provided at a position in the front wall 63 that corresponds to the toner storage chamber 81C. The bearing portion 90C includes a long groove 91C (an example of a second long groove) that extends downward from an upper end 63B of the front wall 63. The long groove 91C is formed shorter than a long groove 91A described below, and may be shorter than the long groove 91A by a height of a projection 92 described below. The long groove 91C supports the rotation shaft 551 when the rotation shaft 551 is inserted therein, and is formed in a shape that, as a whole, tapers downward. An end portion 115 (an example of an open portion) on an upper side of the long groove 91C extends to the opening portion 65, and opens upward. A width of the end portion 115 is formed sufficiently longer than an outer diameter of the rotation shaft 551. Accordingly, when the rotational member 54C is attached, the rotation shaft 551 can be easily inserted in the long groove 91C from the end portion 115.

An end portion 113 (an example of a terminal end portion) of the long groove 91C accommodates and supports the rotation shaft 551, when the rotation shaft 551 is inserted in the long groove 91C. When the lid body 62 is attached to the lower housing 61 after the rotation shaft 551 is inserted in the long groove 91C, the protruding member 77C is inserted in the long groove 91C. At this time, an end of the protruding member 77C is disposed directly above the rotation shaft 551. This allows for a position of the rotation shaft 551 of the rotational member 54C to be determined by the end portion 113 of the long groove 91C. In addition, the lid body 62 can be positioned accurately on the lower housing 61.

[Configuration of Bearing Portion 90A]

In the following, a description is given of a configuration of the bearing portion 90A that supports the rotation shaft 551 (see FIG. 7) of the rotational member 54A. It is noted that a description of the bearing portion 90B is omitted, since the bearing portion 90B has the same configuration as the bearing portion 90A.

Figure 8:
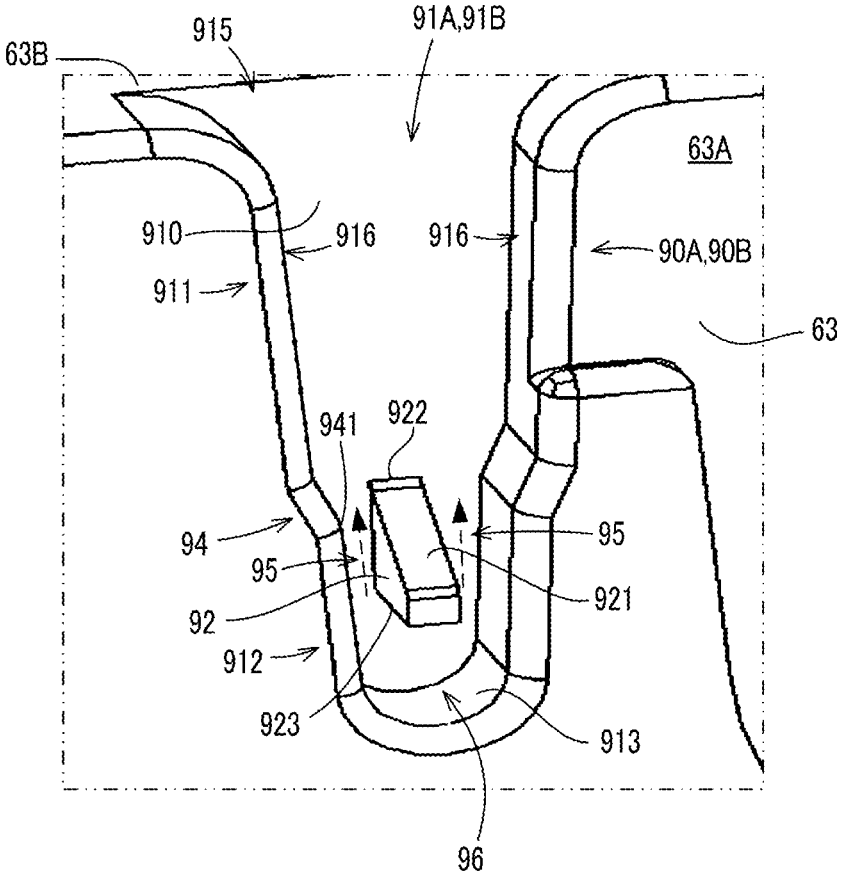
FIG. 8 is an enlarged perspective diagram showing a bearing portion that supports a rotational shaft of a rotational member.
Figure 9:
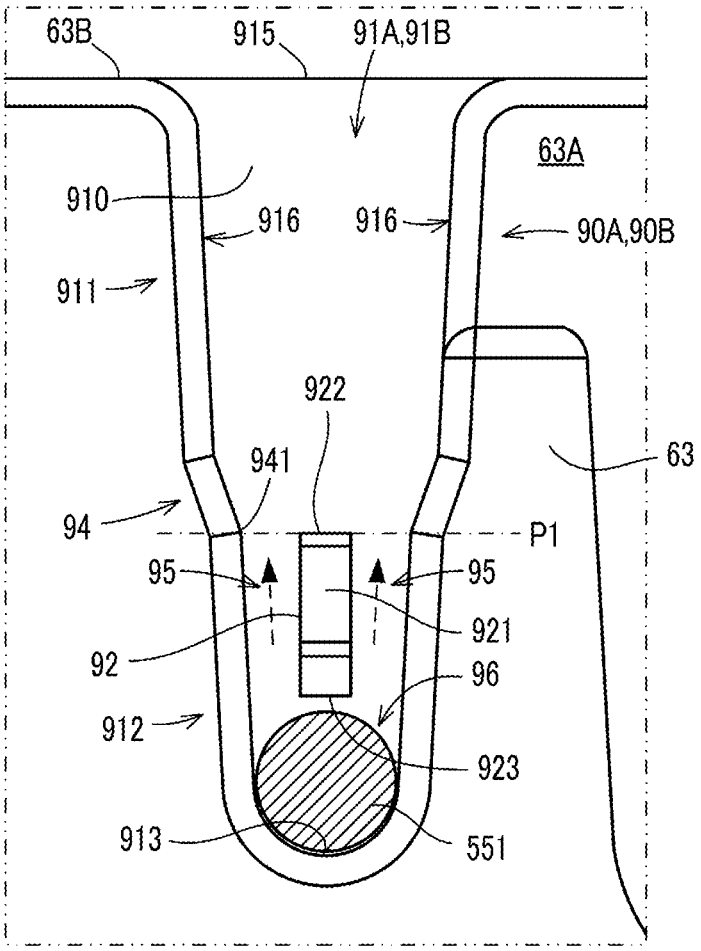
FIG. 9 is an enlarged diagram showing the bearing portion that supports the rotational shaft of the rotational member.

As shown in FIG. 5, the bearing portion 90A is provided in the front wall 63 at a position that corresponds with the toner storage chamber 81A. FIG. 8 and FIG. 9 are enlarged diagrams of the bearing portion 90A. As shown in FIG. 8 and FIG. 9, the bearing portion 90A includes the long groove 91A that extends downward from the upper end 63B of the front wall 63, and the projection 92 that projects horizontally from a groove bottom surface 910 of the long groove 91A. The long groove 91A is formed downward longer than the long groove 91C described above. It is noted that the long groove 91A of the bearing portion 90A and the long groove 91B of the bearing portion 90B are formed in the same shape, and are both examples of a first long groove.

Meanwhile, the bearing portion 90A, in contrast to the bearing portion 90C described above, has a different length from the long groove 91A and includes the projection 92. The bearing portion 90A may have the same configuration as the bearing portion 90C described above, in that it rotatably supports the rotation shaft 551. However, since the long groove 91A is longer than the long groove 91C, the protruding member 77A that is inserted in the long groove 91A needs to be formed longer than the protruding member 77C. In this case, since the protruding member 77A becomes easily bendable, there is a risk that the protruding member 77A cannot stably support the rotation shaft 551 when, for example, the rotation shaft 551 rotates and the protruding member 77A bends by receiving force on its lower end from the rotation shaft 551. On the other hand, if a specific position determining member is provided separately, and inserted in the long groove 91A after the rotation shaft 551 has been inserted in the long groove 91A, although the position of the rotation shaft 551 can be determined at a specific position, it is inconvenient that it is necessary to prepare the separate position determining member. As a solution to these issues, the projection 92 is provided as described below, and the protruding member 77A is formed in the same shape and length as the protruding member 77C to stably support the rotation shaft 551 in the bearing portion 90A at a specific position. In addition, with this configuration, the lid body 62 can be positioned accurately on the lower housing 61.

The long groove 91A supports the rotation shaft 551 when the rotation shaft 551 is inserted therein, and is formed in a shape that, as a whole, tapers downward. An end portion 915 (an example of an open portion) on an upper side of the long groove 91A extends to the opening portion 65, and opens upward. A width of the end portion 915 is formed sufficiently longer than the outer diameter of the rotation shaft 551. Accordingly, when the rotational member 54A is attached, the rotation shaft 551 can be easily inserted in the long groove 91A from the end portion 915. In addition, when the lid body 62 is attached to the lower housing 61, the protruding member 77A can be easily inserted in the long groove 91A from the end portion 915.

An end portion 913 (an example of a terminal end portion) on a bottom side of the long groove 91A accommodates and supports the rotation shaft 551 when the rotation shaft 551 is inserted in the long groove 91A. The end portion 913 is formed, in correspondence to the outer diameter of the rotation shaft 551, in an arc-like shape that curves downward, and specifically, is formed in an arc-like shape with a radius that is slightly longer than the outer diameter of the rotation shaft 551. This allows for the end portion 913 to support the rotation shaft 551 such that the rotation shaft 551 can be rotated smoothly.

Figure 10A:
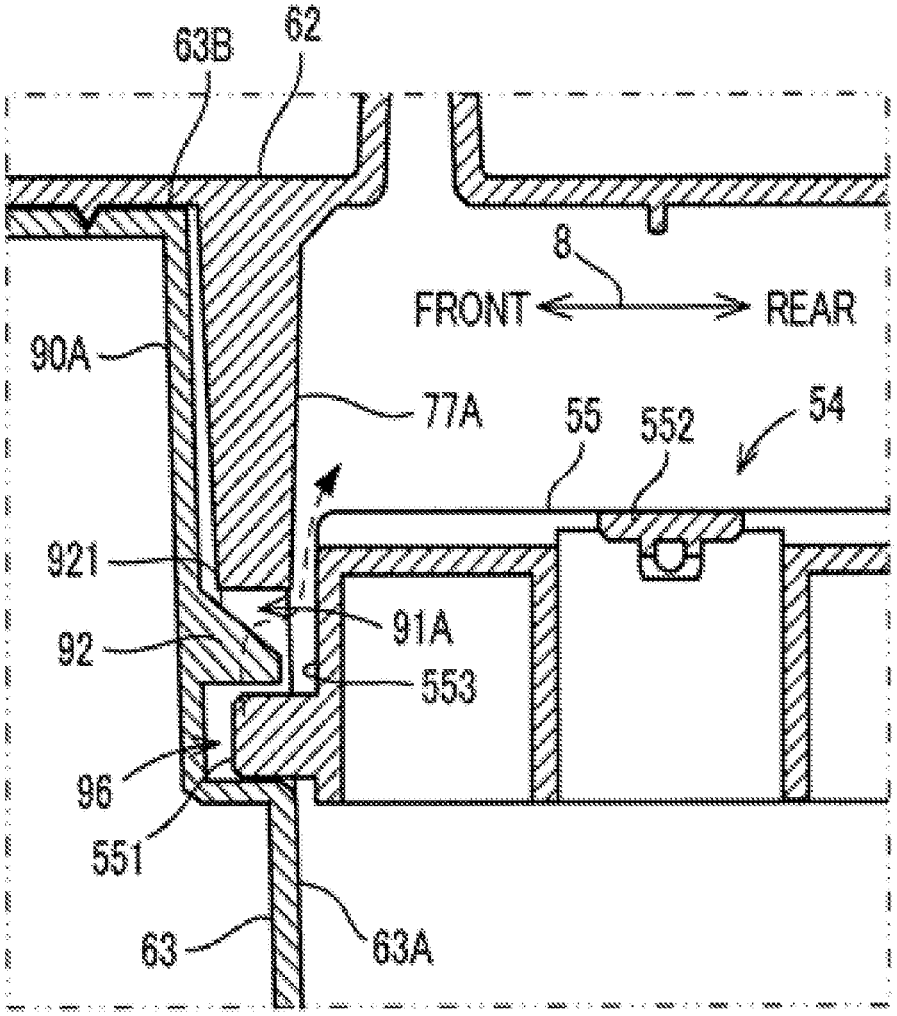
FIG. 10A and FIG. 10B are partial cross-sectional diagrams showing a cross-sectional structure of the rotational shaft of the rotational member and the bearing portion.

In the groove bottom surface 910, the projection 92 is provided in an area between the end portion 915 and the end portion 913. Specifically, the projection 92 is provided at a position separated upward from the end portion 913 by a length of the outer diameter of the rotation shaft 551. With this configuration, between a bottom end 923 of the projection 92 and the end portion 913, a shaft storage portion 96 is formed in which the rotation shaft 551 is loosely fitted such that it can be rotated smoothly. That is, in the groove bottom surface 910, the projection 92 is provided at a position where the rotation shaft 551 can be loosely fitted therein. As shown in FIG. 10A, a protrusion length of the projection 92 is shorter than a groove depth of the long groove 91A. Accordingly, even if the projection 92 is provided in the groove bottom surface 910, when the rotational member 54A is pushed down in a state where the rotation shaft 551 inserted in the long groove 91A is in contact with an upper end 922 of the projection 92, the rotation shaft body 55 bends, and the rotation shaft 551 can be pushed over the projection 92 to be disposed in the shaft storage portion 96. When the rotation shaft 551 is stored in the shaft storage portion 96, the rotation shaft body 55 returns to its unbent state. At this time, a click feeling is transmitted from the rotation shaft body 55 to a hand of a worker. Accordingly, the worker can recognize when the rotational member 54A is properly attached by sensing the click feeling.

In order for the rotation shaft 551 to be capable of being easily pushed over the projection 92, the projection 92 is formed in a plate-like shape that extends in a longitudinal direction of the long groove 91A, and a width of the projection 92 is smaller than a groove width (a width in the left-right direction 9) of the long groove 91A. In other words, the projection 92 is a plate-like member having a width that is smaller than the groove width of the long groove 91A. In addition, an inclined surface 921 is formed on the projection 92, wherein the inclined surface 921 is inclined obliquely downward and extends, toward a protrusion direction of the projection 92, from the upper end 922 on the end portion 915 side. In this way, the projection 92 is formed narrower than the groove width of the long groove 91A and includes the inclined surface 921. This allows for the rotation shaft 551, when it is inserted in the long groove 91A, to be guided smoothly by the inclined surface 921 toward the shaft storage portion 96, without producing interfacial friction. In addition, a bottom surface of the projection 92 is perpendicular to the groove bottom surface 910. Accordingly, the bearing portion 90A has a configuration that prevents the rotation shaft 551 that is stored in the shaft storage portion 96 from becoming displaced from the shaft storage portion 96.

In addition, the projection 92 is provided at a center of the groove bottom surface 910 in a width direction of the long groove 91A. Accordingly, two paths 95 (examples of a toner path) are formed on both sides of the long groove 91A in a width direction of the projection 92, wherein each path 95 is partitioned off by a side surface of the projection 92 and a groove side surface 916 of the long groove 91A. With this configuration, even if toner enters a space between the shaft storage portion 96 and the rotation shaft 551, the toner can be cleared out upward (see dashed arrow in FIG. 8 and FIG. 9) through the paths 95, when the toner is made to flow by a rotational movement of the rotation shaft 551. Accordingly, circulation of toner in the shaft storage portion 96 is improved, and accumulation of toner in the shaft storage portion 96 can be prevented by force received from the rotational movement of the rotation shaft 551.

In addition, a tapered portion 94 is formed in the long groove 91A at a position corresponding to the upper end 922 of the projection 92, in a shape that tapers in groove width in a downward direction. The tapered portion 94 divides the long groove 91A into an upper groove portion 911 (an example of a groove inner portion) that is above the tapered portion 94, and a lower groove portion 912 that is below the tapered portion 94. That is, the upper groove portion 911 is a part of the long groove 91A and extends from the end portion 915 to the upper end 922 of the projection 92. While a groove width of the upper groove portion 911 is formed wider than the lower groove portion 912 due to the downward tapered shape of the long groove 91A, the formation of the tapered portion 94 further expands a groove width of an upper side of the lower groove portion 912. The protruding member 77A is inserted in the upper groove portion 911.

In the present embodiment, the projection 92 is provided in the lower groove portion 912. As shown in FIG. 9, the tapered portion 94 is formed such that a terminal end 941 (bottom end of the tapered portion 94) of the tapered portion 94 is positioned on a reference line P1 that extends horizontally and passes through the upper end 922. Accordingly, since toner moving upwards through the paths 95 moves into the widened upper groove portion 911 as it exits from upper sides of the paths 95, the toner can easily move from a space between the upper groove portion 911 and the protruding member 77A to the toner storage chamber 81A.

In the toner container 50 described above, when the rotational members 54 are rotated in a direction of an arrow D10, toner stored inside the toner storage chambers 81A, 81B, and 81C of the container body 60 is stirred by the stirring members 56. In addition, rotation of the rotational member 54C disposed in the toner storage chamber 81C that is closest to the supply port 67 in the container body 60, causes the toner to not only be stirred, but scooped upward along an inner surface of the right wall 74. The scooped up toner is lifted up and carried to the toner conveyance path 126. Then, the toner is conveyed by the conveyance member 58 to the supply port 67, and supplied from the supply port 67 to the developing device 33.

In addition, in the toner container 50, since the bearing portions 90A and 90B respectively include the long grooves 91A and 91B in which the rotation shafts 551 are inserted, and the projections 92 that protrude from the groove bottom surfaces 910 of the long grooves 91A and 91B, the rotation shafts 551 of the rotational members 54A and 54B can be easily attached to the container body 60. In addition, without using any additional parts, it is possible to stably dispose each rotation shaft 551 in the shaft storage portion 96 as a standard position.

Figure 10B:
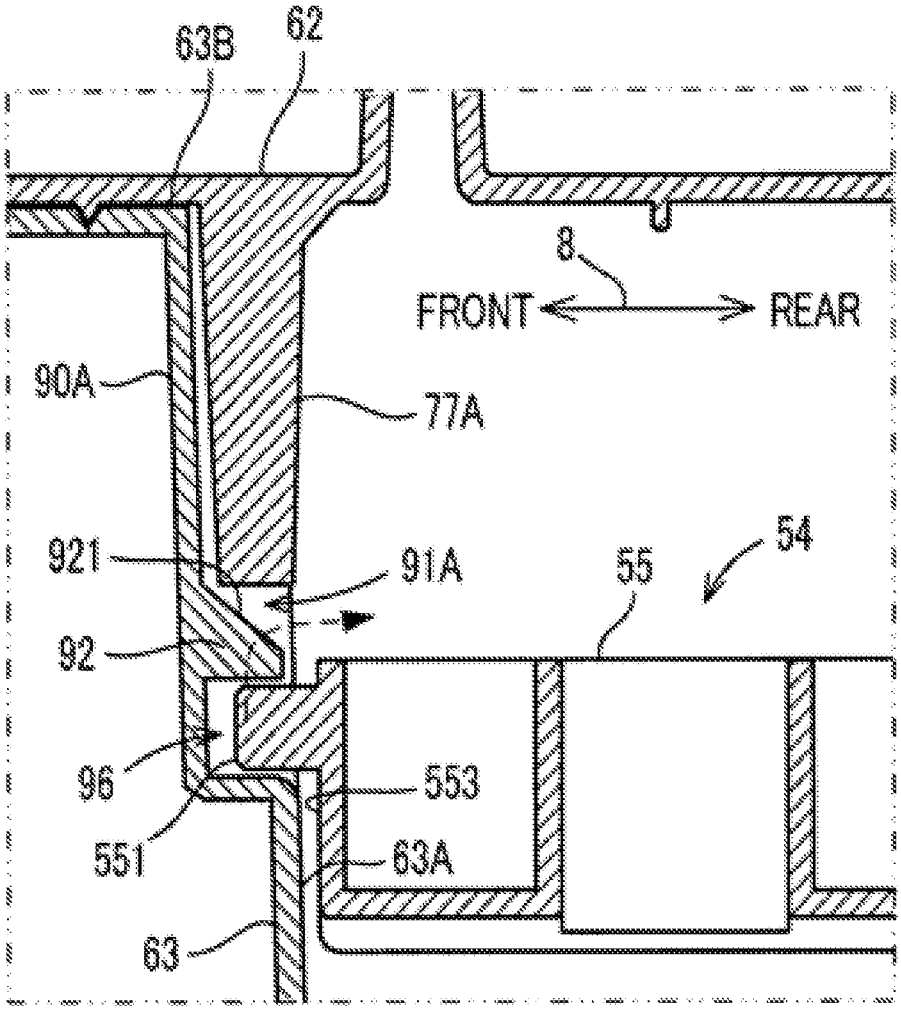

In addition, as shown in FIG. 10A and FIG. 10B, the rotation shaft 551 is provided at a position shifted from a center of an edge surface 553 that is on one side in the longitudinal direction of the rotation shaft body 55. Accordingly, during rotation of the rotational members 54A and 54B in the bearing portions 90A and 90B, the rotational members 54A and 54B each repeatedly pass between a facing position (shown in FIG. 10A) and a non-facing position (shown in FIG. 10B), wherein the edge surface 553 faces the projection 92 at the facing position, and the edge surface 553 does not face the projection 92 at the non-facing position. With this configuration, mobility of toner around the projection 92 is improved, and toner in between the shaft storage portion 96 and the rotation shaft 551 can be circulated efficiently.

Meanwhile, in a configuration in which multiple rotational members 54 are juxtaposed inside the toner container 50 along a width direction, when the rotation members 54 rotate, each stirring member 56 repeatedly alternates between a contact attitude and a non-contact attitude, wherein in the contact attitude, an end side of the stirring member 56 is in a bent state and is slid while in contact with the inner surface of the container body 60, and in the non-contact attitude, the end side of the stirring member 56 is not in contact with the inner surface of the toner container 50. When the stirring member 56 becomes unbent from the contact attitude and shifts into the non-contact attitude during rotation of the rotational member 54, a flicking sound is generated as the stirring member 56 is separated from the inner surface of the container body 60. Here, the flicking sound is an abnormal noise that is generated by an elastic force (restoring force) of the stirring member 56 trying to return its original state, when it is unbent and shifted from its bent state to a state where it is not in contact with the inner surface of the container body 60. When the rotational members 54 rotate and the flicking sounds occur at the same time, the flicking sounds can become overlapped and generate a large abnormal sound.

Figure 11A:
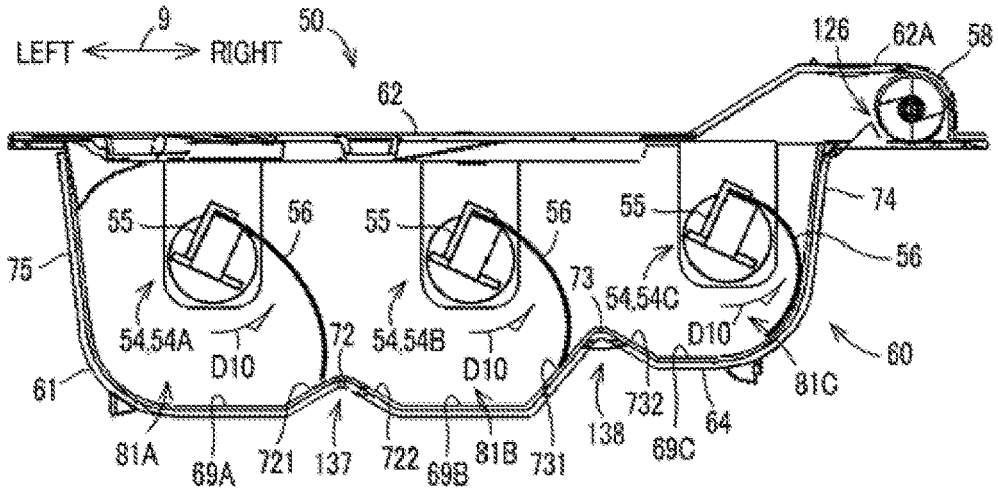
FIG. 11A to FIG. 11C are cross-sectional diagrams showing rotational movement of the rotational members.
Figure 11B:
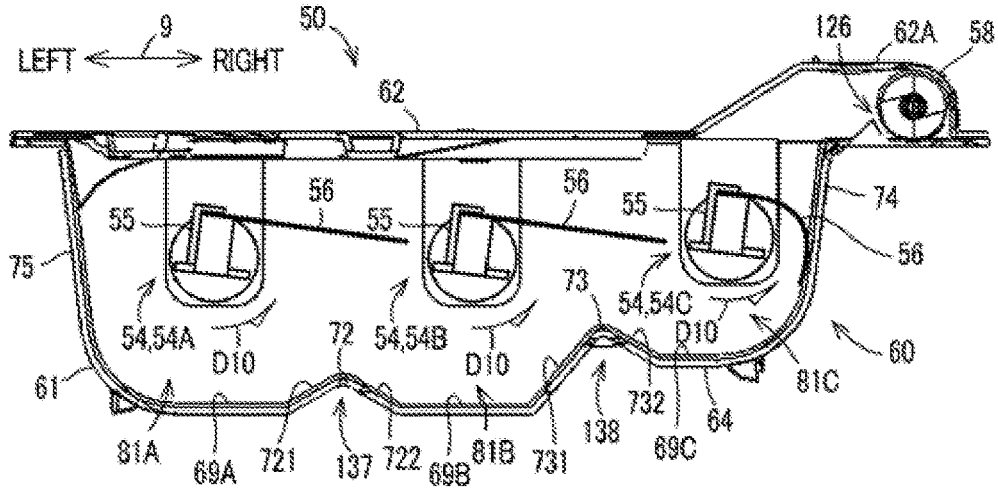
Figure 11C:
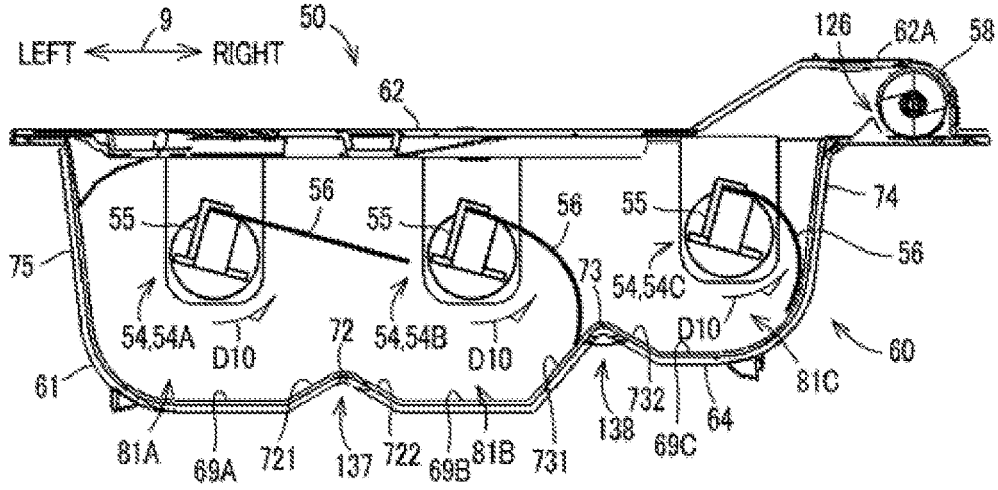

To solve this issue, in the toner container 50 according to the present embodiment, since heights of the ribs 72 and 73 are different as described above, movement of the stirring member 56 is different for each of the rotational members 54, as shown in FIG. 11A to FIG. 11C. With this configuration, the timings of the flicking sounds that are generated when the stirring members 56 are separated from the bottom surface 69 and the inner surface of the container body 60, are also different.

Specifically, when the rotational members 54 are rotated in the direction of the arrow D10 from the state shown in FIG. 6, during this rotation, the stirring members 56 are slid along while in contact with the bottom surface 69 of the container body 60, and bent in a curved shape (see FIG. 11A). When the stirring members 56 are rotated further from this state, first, the stirring member 56 of the rotational member 54A is separated from the inclined surface 721 of the rib 72 (see FIG. 11B). At this time, the flicking sound is generated from the stirring member 56 of the rotational member 54A. However, the stirring member 56 of the rotational member 54B is sliding against the inclined surface 731, and the stirring member 56 of the rotational member 54C is sliding against the inner surface of the right wall 74, so the flicking sound is not generated therefrom.

When the rotation members 54 are rotated even further, next, the stirring member 56 of the rotational member 54B is separated from the inclined surface 731 of the rib 73 (see FIG. 11C). At this time, the flicking sound is generated from the stirring member 56 of the rotational member 54B. However, the stirring member 56 of the rotational member 54A is not in contact with any surface, and the stirring member 56 of the rotational member 54C is sliding against the inner surface of the right wall 74, so the flicking sound is not generated therefrom.

When the stirring members 56 are rotated further again, the stirring member 56 of the rotational member 54C is separated from the inner surface of the right wall 74, and the flicking sound is generated.

As described above, since the rotation members 54 each generate the flicking sound at a different timing, and the flicking sounds do not overlap during rotational movement of the rotational members 54, it is possible to prevent the large abnormal sound from being generated at one time.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container, comprising:

a container body in which toner is stored;

a first projecting member and a second projecting member that are provided on a bottom surface of the container body, configured to divide an inner space of the container body into a plurality of toner storage chambers that are juxtaposed along a width direction of the container body, and formed parallel to one another;

a plurality of rotational members rotatably provided, respectively, in the plurality of toner storage chambers, and juxtaposed in the width direction;

a toner conveyance path on which a supply port for supplying toner to an outer portion is formed, the toner conveyance path provided on one end in the width direction of the container body, at a position that is above the plurality of toner storage chambers; and a conveyance member rotatably provided in the toner conveyance path, and configured to convey, toward the supply port, toner inside the toner conveyance path when the conveyance member is rotated, wherein the rotational members each include a rotational shaft body, and a film-like stirring member that is attached to the rotational shaft body and extends in a direction perpendicular to that of the rotational shaft body, the plurality of toner storage chambers include three storage chambers that are juxtaposed in the width direction, the first projecting member divides two storage chambers that are positioned on an opposite side of the supply port, the second projecting member divides two storage chambers that are positioned on the supply port side, a height of the first projecting member from the bottom surface is different from a height of the second projecting member from the bottom surface, and a height of the second projecting member is higher than that of the first projecting member.

2. The toner container according to claim 1, wherein each stirring member of the plurality of rotational members is arranged to extend in a same direction.

3. The toner container according to claim 1, wherein the first projecting member and the second projecting member are each formed having a chevron-shaped cross-section.

* * * * *